US006170131B1

(12) United States Patent
Shin

(10) Patent No.: US 6,170,131 B1
(45) Date of Patent: Jan. 9, 2001

(54) MAGNETIC BUTTONS AND STRUCTURES THEREOF

(76) Inventor: Kyu Ho Shin, 164-9, Samjeon-Dong, Songpa-Ku, Seoul (KR)

( * ) Notice: Under 35 U.S.C. 154(b), the term of this patent shall be extended for 0 days.

(21) Appl. No.: 09/323,902

(22) Filed: Jun. 2, 1999

(51) Int. Cl.[7] ..... A44B 1/00; A44B 17/00
(52) U.S. Cl. ..... 24/303; 24/66.1
(58) Field of Search ..... 24/303, 66.1, 658, 24/688; 292/251.5

(56) References Cited

U.S. PATENT DOCUMENTS

| | | | | |
|---|---|---|---|---|
| 3,111,737 | * | 11/1963 | Heil | 24/303 |
| 4,265,002 | * | 5/1981 | Hosken | 24/303 |
| 4,455,719 | * | 6/1984 | Morita | 24/303 |
| 4,480,361 | * | 11/1984 | Morita | 24/303 |
| 4,736,494 | | 4/1988 | Marchesi . | |
| 4,924,559 | | 5/1990 | Marchesi . | |
| 5,249,338 | * | 10/1993 | Aoki | 24/303 |
| 5,450,658 | * | 9/1995 | Hicks | 24/303 |

* cited by examiner

*Primary Examiner*—Victor N. Sakran
(74) *Attorney, Agent, or Firm*—Hoffman, Wasson & Gitler

(57) ABSTRACT

This invention relates to a novel design of detachable/attachable magnetic buttons that can be used on clothes, accessories, and the like. Specifically, the invention also relates to a contact guiding structure of the button for a smooth detaching/attaching and an improved stability thereof.

The magnetic button of the present invention is arranged so that the magnets on the flap and the body have opposite polarities from each other. Each magnet housing is placed around each magnet in order to make one magnet to be placed in that of the corresponding opposite button. Furthermore, to prevent magnets from slipping and to enhance their durability, a barrier is placed between the magnet and the housing. Hence, the stability of the contact portion of the button and the smooth detachment/attachment are more facilitated.

4 Claims, 9 Drawing Sheets

MAGNETIC BUTTONS AND STRUCTURES THEREOF

BACKGROUND OF THE INVENTION

1. Field of the Invention

This invention relates to a detachable magnetic button used on clothes, accessories, and the like. Specifically, this new design of the magnetic button relates to a structure of the magnetic button in order to enhance a smooth detaching attaching action of the button and thereby to obtain the button's stability.

2. Discussion of Related Art

Most products using magnetic buttons have magnets on their body, and semi-magnets (no or little magnetic attraction) are placed on the flap for attaching and detaching the flap to and from their body, respectively.

FIG. 1A shows the current usage of a magnetic button on a handbag. Generally, a magnet 2 is placed on the body of the handbag 1, and a semi-magnet 4 corresponding to the magnet 2 is placed on the flap 3 to form a magnet contact between the two.

As shown in FIGS. 1B and 1C, the magnet 2 is fixed on the body 1 such that a fixed pad 6 is placed on the inner side of the outer cover 5 and that the magnet 2 is on the outer side. The fixed magnet forms a secure groove 7 on the fixed pad 6. Facing the secure groove inside magnet 2, a securing pin 8 is placed through the outer skin 5. The pin also reaches the fixed pad 6. Another groove 9 is placed on magnet 2.

The semi-magnet 4 on the flap 3 is shown in FIG. 1B. A fixed pad 6*a* with a secure groove 7*a* on it is attached to the inner skin 10 of the flap 3. Fixing the semi-magnet 4 on the flap is achieved by fixing a secure pin 8*a* on the secure groove 7A. A protrusion 11 is placed on the semi-magnet 4.

The handbag is closed when the flap 3 moves towards the body 1. The protrusion 11 on the semi-magnet 4 of the flap 3 is placed in the groove 9 of the magnet 2, and a magnetic interaction between the magnet 2 and the semi-magnet 4 is formed.

On the other hand, the handbag is opened when the semi-magnet 4 on the flap 3 is separated from the magnet 2 on the body 1. The protrusion 11 on the semi-magnet comes out of the groove 9 on the magnet 2.

The magnetic button, in FIG. 2, can be also used as a snap button on clothes 12, accessories, and the like. Attachment and detachment between the protrusions 11 of the semi-magnet 4 and the groove 9 on the magnet 2 is achieved in the same manner as before.

The conjunction between the groove 9 on the magnet 2 and the protrusion 11 of the semi-magnet 4 in an ordinary button enhances attachability. However, the protrusion 11 must be put in the groove 9 precisely for a smooth attachment.

Therefore, the design of the groove 9 on the magnet 2 and the protrusion 11 on the semi-magnet 4 makes it hard to achieve a smooth attachment and hence makes it less efficient. Furthermore, the attachment is broken easily by a little force. The old-fashioned button design also makes it less attractive.

SUMMARY OF THE INVENTION

In an ordinary magnetic button, a magnet with a groove is placed on a body and a semi-magnet with a protrusion is put on the flap. Attachment and detachment between the body and the flap occurs due to the conjunction between the groove and the protrusion. For this purpose, one has to carefully manage to match the two. Thus, rapid attachment is difficult. Stability is also unreliable, and the old design makes it less attractive.

Therefore, this invention provides for good stability and easy attaching/detaching. Another purpose of this invention is to provide wider creativity of fashionable designs.

BRIEF DESCRIPTION OF THE ATTACHED DRAWINGS

An example of current magnetic buttons is shown in FIGS. 1A–1C. FIG. 1A represents the usage on a handbag, whereas FIG. 1B is a detailed representation of "B" in FIG. 1A and FIG. 1C of "A" in FIG. 1A.

Another example of a magnetic button used on clothes is shown in FIG. 2.

FIGS. 3A–3C show a suggested usage of our novel product of the invention. FIG. 3A is an applied usage in a handbag, whereas FIG. 3B is a detailed drawing of "D" in FIG. 3A, and FIG. 3C of "C" is FIG. 3A. FIG. 3D is a detailed figure of the magnet housing and the magnet itself.

FIGS. 4A–4E are another example of the present invention. FIG. 4A is an applied usage in a handbag, whereas FIG. 4B is a detailed drawing of "F" in FIG. 4A, and FIG. 4C of "E" in FIG. 4A. FIG. 4D is a detailed figure of the magnet housing and the magnet. FIG. 4E is another detailed figure of the magnetic button.

FIGS. 10A and 10B show a detailed illustration of a magnetic zipper, wherein FIG. 10A illustrates the stage before being installed, and FIG. 10B illustrates the zipper already installed.

DETAILED DESCRIPTION OF PREFERRED EMBODIMENT

Figure 1A:
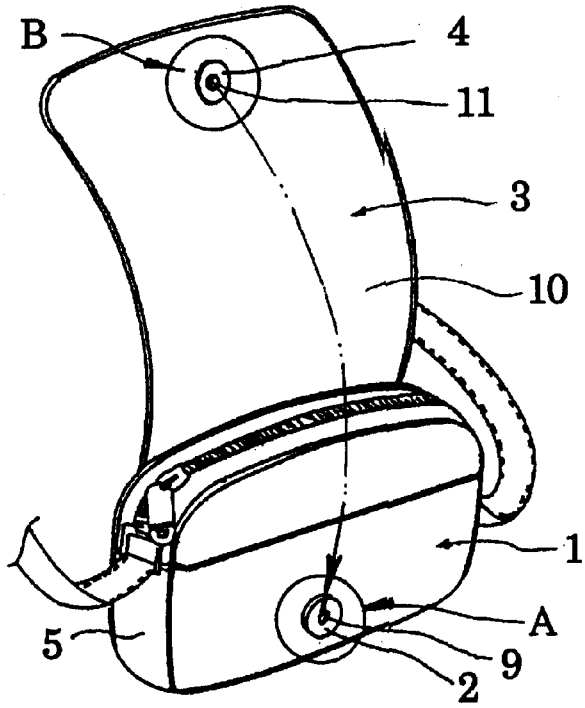
Figure 1B:
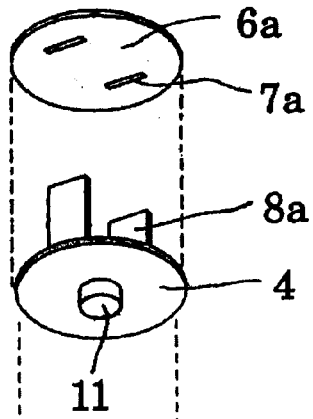
Figure 1C:
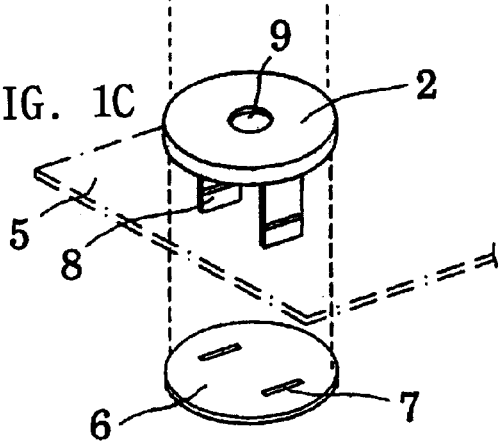
Figure 2:
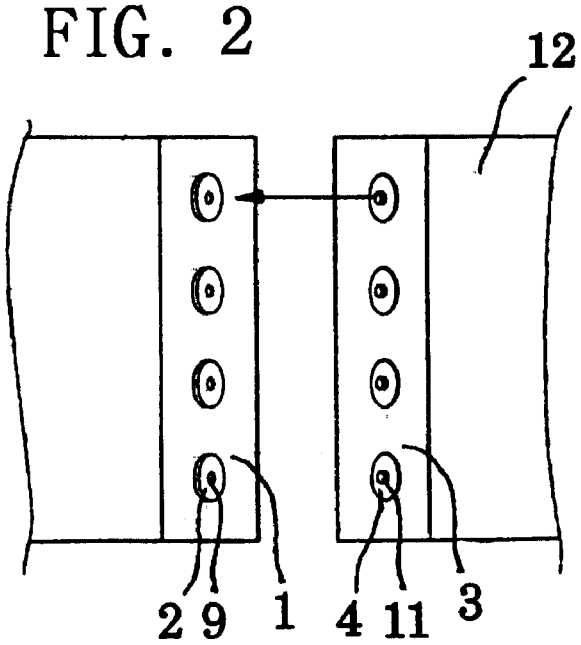

In order to achieve these purposes, on the inner side of the outer cover of the body is placed a fixed pad with a secure groove. On the outer side of the outer skin is a magnet with a secure pin that forms a conjunction with the secure groove through the outer cover. Attachment is made between a semi-magnet on the cover and the magnet on the body.

Magnets with opposite polarities are placed on both sides;

Magnet housings surround the magnets and one housing can move into the other housing upon attachment;

A barrier is placed around the magnet housing to prevent the slipping of the magnets.

Alternatively, the barrier is placed around only one magnet.

Alternatively, a limiting band can be placed around the barrier and the upper ring of the magnet housing.

Alternatively, a small column guiding groove is placed in the middle of the magnets and housings. A column pad on which a column is fixed, is closely placed on the floor of the magnets.

Alternatively, one can determine whether to make a barrier around the housings on the basis of the columns fixed around the column guiding grooves.

Alternatively, the outside of the magnet housing and the barrier resemble a wing.

Alternatively, the bottom and upper end of the housing body are open.

Alternatively, small space for the magnet to move in the housing is allowed, and to prevent too rigorous movement, a limiting band is placed inside the barrier.

Another characteristic of this invention is that magnets on the left and right side of a zipper are placed complementary to each other. On one side of the zipper are placed several magnetic buttons at regular intervals. On the other side are placed the same number of magnets with opposite polarities.

By doing this, fast and smooth attaching/detaching can occur, and stability is further enhanced. Variable fashion designs including longitudinal arrangement of buttons are also allowed regardless of external appearance and pattern.

Referring to the drawings, a detailed explanation of the invention will be followed.

In FIGS. 3A–3D, two magnets 20 and 20*a* with opposite polarities are placed on the body 1 and the flap 3. The magnet housings 21 and 21*a* around the magnets 20 and 20*a* are made, so that one housing can move into the other housing. In order to prevent the magnets from slipping, the barriers 22 and 22*a* are placed on the bottom 21' and 21'*a* of the housings.

In detail, the magnet housing 21*a* with the magnet 20 and the secure pin 8*a* is placed on the body 1. The barrier 22*a* and the secure pin groove 24*a* are on the bottom 21'*a* of the magnet housing. The magnet housing 21'*a* with the magnet 20 is placed on the flap 3. The barrier 22 and the secure pin groove 24 form the magnet housing bottom 21'.

Figure 3A:
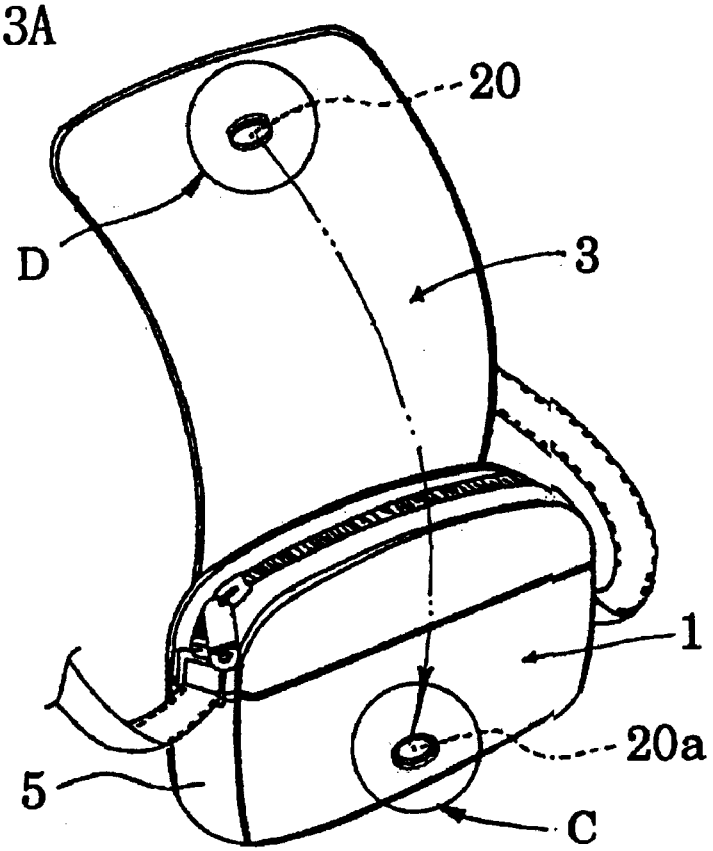
Figure 3B:
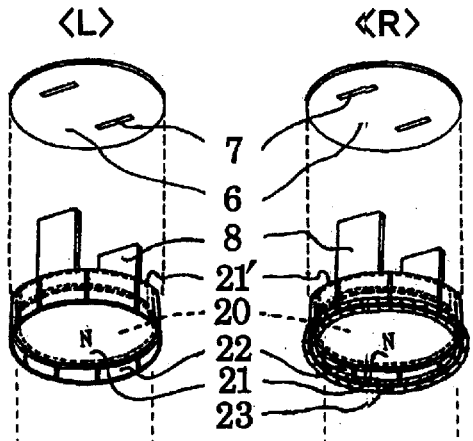
Figure 3C:
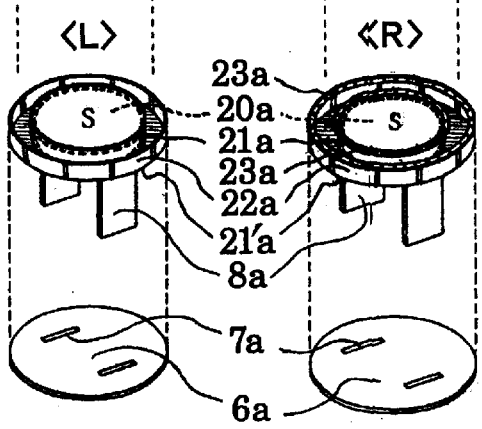
Figure 3D:
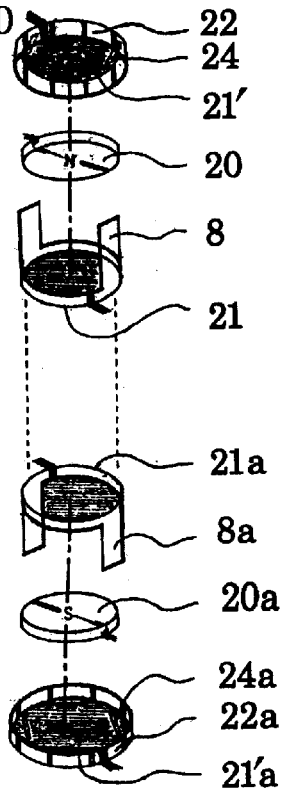

As seen in R in FIG. 3B and FIG. 3C, the limiting bands 23 and 23*a* are placed on the upper end of the barriers 22 and 22*a* and the housing body to prevent the magnets from slipping.

An example of the bands 23 and 23*a* is L in FIG. 3B and FIG. 3C. The barriers 22 and 22*a* formed at the axes of the magnet housings prevent longitudinal slipping. However, stability is still not guaranteed. For this, the bands 23 and 23*a* around the upper end of the housing body 21*a* and the barriers 22 and 22*a* are used as seen in R of FIG. 3B and FIG. 3C.

Due to the usage of these bands, the magnets are less likely to move uncontrollably.

In FIGS. 4A–4E, the barriers 22 and 22*a* on the bottom of the housing 21' and 21'*a* are placed on only one of the two sides depending on the magnets 20 and 20*a*. In the center of the magnets 20 and 20*a* and the housing bodies 21 and 21*a* are formed the column guiding grooves 30 and 30*a*. On the bottom surface of the magnets 20 and 20*a* are the columns 29 and 29*a* and the column bases 28 and 28*a*. The magnets 20 and 20*a* and the columns 29 and 29*a* are facing each other with opposite polarities N and S.

Another example of the invention is shown in FIGS. 4A–4E. On the body of the handbag 1 is composed of the magnet housing body 21*a* formed by a column guiding groove 30*a* and a secure pin 8*a;* the magnet 20*a* with a column guiding groove 30*a* in the center; and the bottom 21'*a* of the housing body with the secure pin groove 24*a* and the column base 28*a* on which a column 29*a* is fixed. On the cover 3 is composed of the housing body 21 formed by the column guiding groove 30 and a secure pin; and the magnet with a column guiding groove in the middle; and the housing bottom 21' formed by a column base 28 and barrier 22 with a secure pin groove 24.

Figure 12:
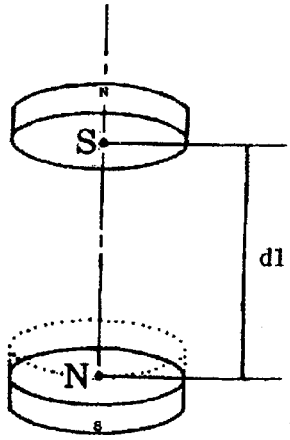
FIG. 12 shows an illustration of the two magnets engaging.

An example of usage of columns 29 and 29*a* and column bases 28 and 28*a* is shown in FIG. 12. At the appropriate distance d1 between the two magnets 20 and 20*a,* a strong magnetic interaction arises between the magnets 20 and 20*a* with the opposite polarities N and S.

In this invention, however, since the magnets 20 and 20*a* are surrounded by the housings 21 and 21*a,* the magnets cannot come into direct contact with each other. Thus, the indirect contact through housing bodies 21 and 21*a* results in a weaker magnetic interaction.

So, the column bases 28 and 28*a* with a magnetic property and the columns 29 and 29*a* put on the bottom of the magnets 20 and 20*a* absorb the magnetic attraction generated at the bottom. The absorbed force is transmitted to the columns 29 and 29*a,* so that the columns 29 and 29*a* can generate a magnetic attraction.

Thus, the columns with magnetic attraction exert a stronger, indirect interaction than the direct contact between magnets.

The magnets 20 and 20*a* form an indirect contact and the columns 29 and 29*a* form the contact with each other so that an even stronger force is generated.

In the above examples, the barriers 22 are placed only at the bottom 21' of the housing. Occasionally as seen in FIG. 4E, the barrier 22 can be put on the upper ring of the housing body 21.

Figure 4A:
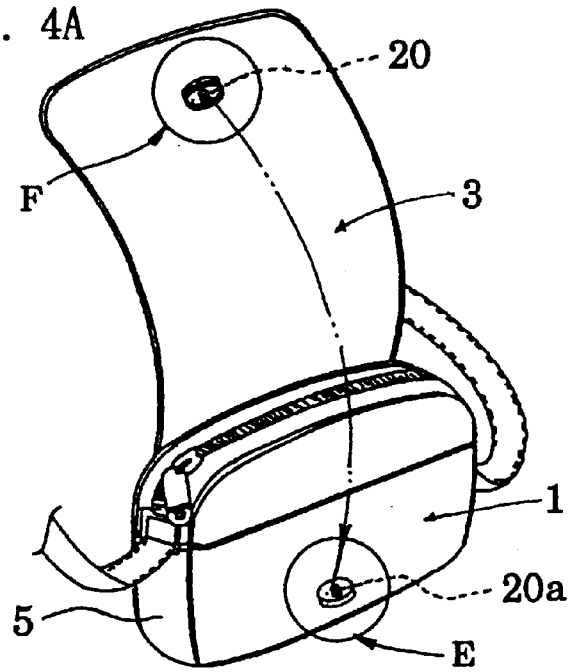
Figure 4B:
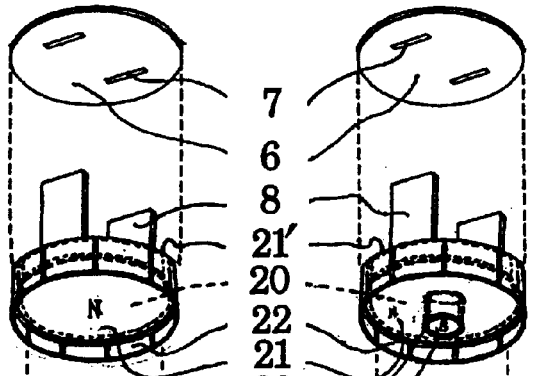
Figure 4C:
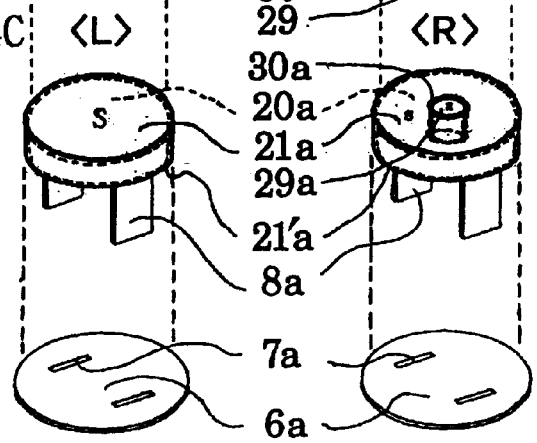
Figure 4D:
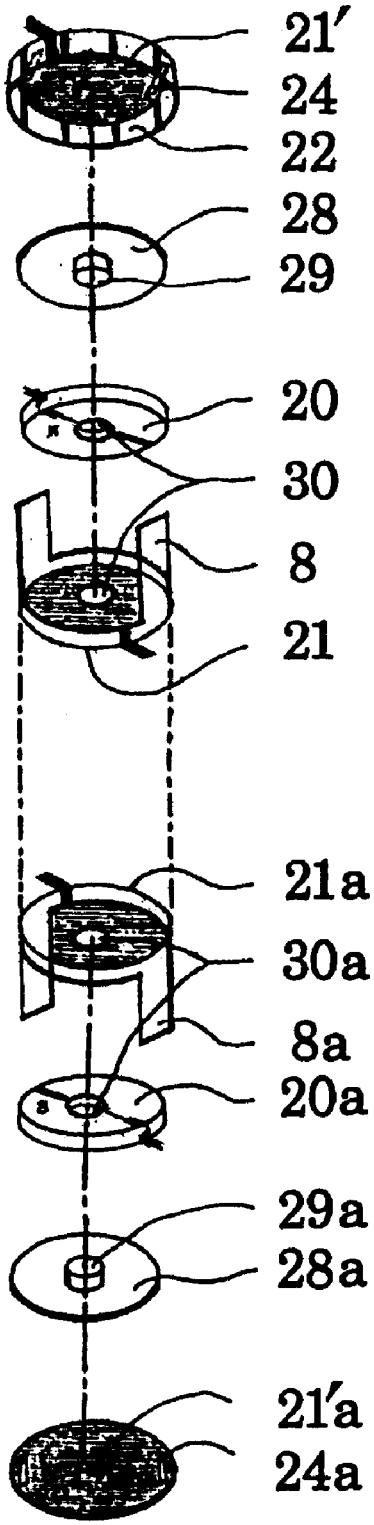
Figure 4E:
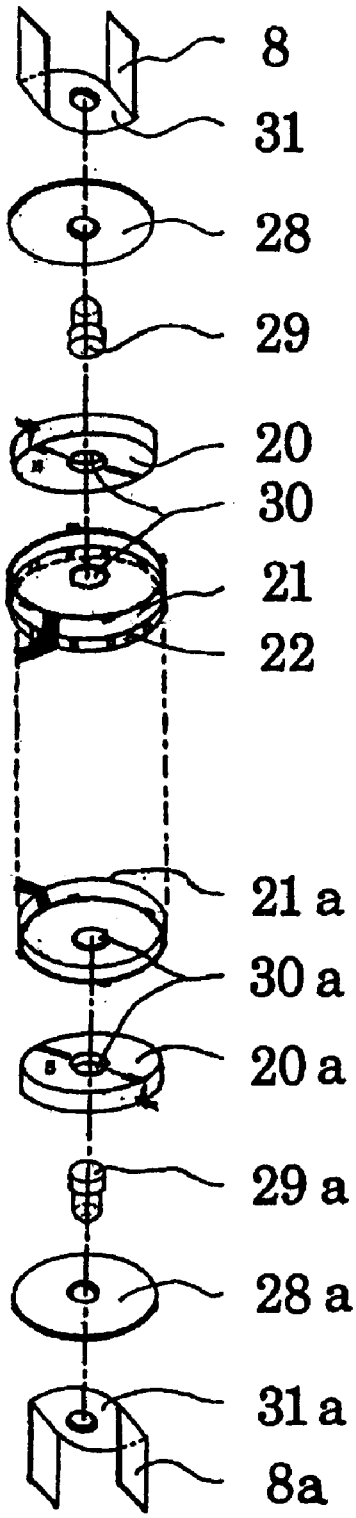

As seen in FIG. 4E showing another example of the magnetic button, the magnet housing 21*a* with the column guiding groove 30*a* and the magnet 20*a* with the column guiding groove 30*a* in the middle is placed on the body 1. The secure pin 8*a* formed by the column base 28*a* and the secure pin body 31*a* are on the body 1. The magnet housing 21'*a* with the column guiding groove 30 and the barrier 22 is put on the flap 3. The magnet 20 with the column guiding groove 30 in the middle and the column are on the flap 3 as well. The secure pin 8 formed by the column base 28 and the secure pin body 31 are on the flap.

In FIGS. 4A–4E, for the columns 29 and 29*a* fixed at the axes of the column guiding grooves 30 and 30*a,* the column 29 and its guiding crevice 30*a* can function as a pair without the barriers 22.

Figure 5A:
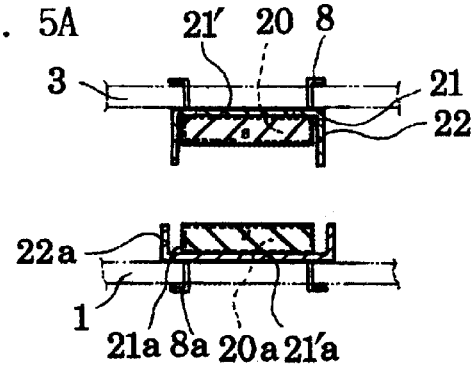
FIGS. 5A and 5B show a separated magnetic button and a horizontal section of the magnet contact in FIGS. 3B–3D.
Figure 5B:
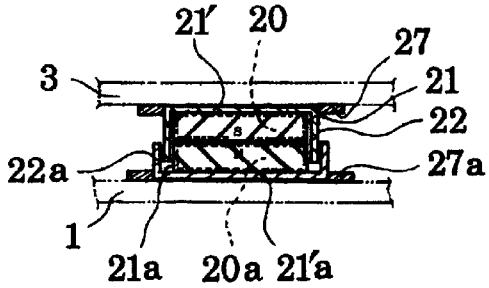

In FIGS. 5A and 5B, the attachment/detachment surfaces are shown. FIG. 5A is the stage where the magnets 20*a,* 20 on the body 1 and the cover 3, respectively are about to come together. By using the secure pins 8 and 8*a* on the bottom 21' and 21'*a* of the magnet housing, the magnets 20 and 20*a* on the body 1 and the cover 3, respectively are formed. FIG. 5B is the view that illustrates the contact between the magnet 20*a* on the body 1 and the magnet 20 on the cover 3. By using the wings 27 and 27*a* on the outer surface of the barriers 22 and 22*a,* the magnets 20 and 20*a* can be placed on the body 1 and the cover 3.

Figure 6A:
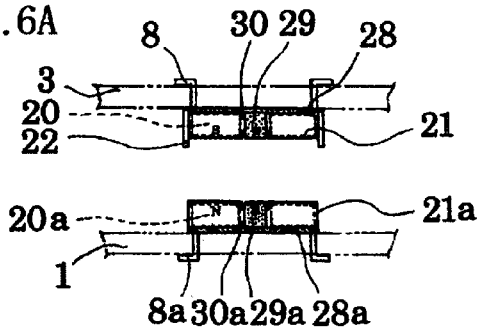
FIGS. 6A and 6B show a magnetic button separated and a horizontal section of the conjunction contact in FIGS. 4B–4E.
Figure 6B:
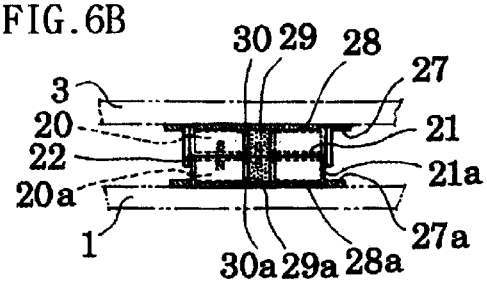

FIGS. 6A and 6B are the attachment sectional view of FIGS. 4B–4E. FIG. 6A is the stage when the magnet 20*a* on the body 1 and the magnet 20 on the cover 3 are about to come together. By using the secure pins 8 and 8*a* on the bottom 21' and 21'*a* of the magnet housing, magnets 20 and 20*a* on the body 1 and cover 3 are fixed. FIG. 6B is about the stage that the magnets 20 and 20*a* of the body 1 and cover 3 are already in contact. By using the wings 27 and 27*a* around the outer surface of the housing 21 and the barrier 22, the magnets 20 and 20*a* are placed on the body 1 and cover 3.

Figure 7A:
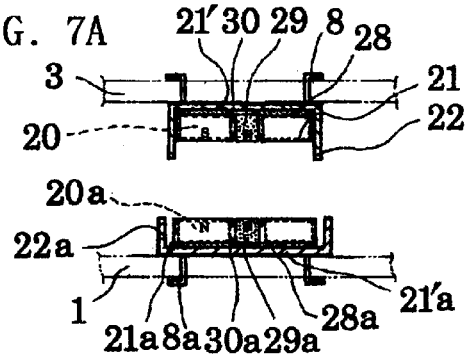
FIGS. 7A and 7B show another example of a separated magnetic button and a horizontal section of the magnet contact.
Figure 7B:
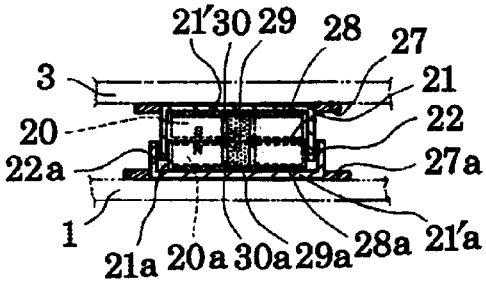

FIGS. 7A and 7B are similar to FIGS. 6A and 6B except that FIGS. 6A and 6B have a barrier on only one side (either the body 1 or the cover 3); however FIGS. 7A and 7B have barriers on both sides, i.e. on both the body 1 and the cover 3.

Figure 8A:
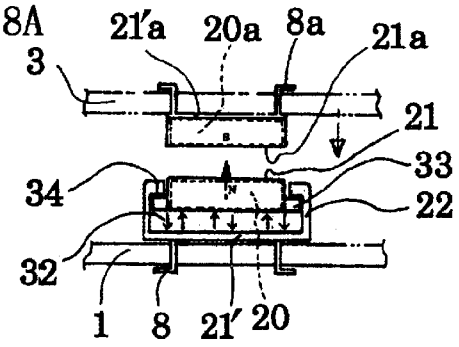
FIGS. 8A and 8B show another example of a magnetic button separated and a horizontal section of the conjunction contact.
Figure 8B:
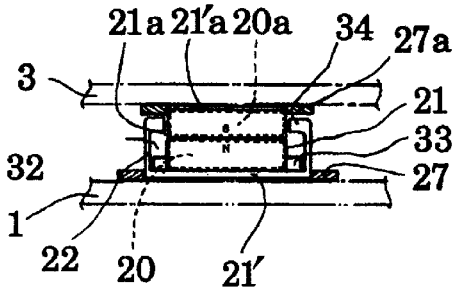
Figure 11:
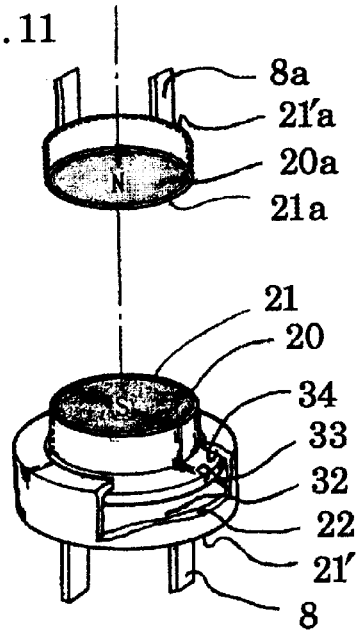
FIG. 11 shows another detailed illustration of the invention in FIGS. 8A and 8B.

FIG. 7A is the stage where the magnet 20*a* on the body 1 and the magnet 20 on the cover 3 are about to come together. By using the secure pins 8 and 8*a* on the bottom 21' and 21'*a* of the magnetic housing, the magnets 20 and 20*a* on the body 1 and the cover 3 are formed. FIG. 7B is the picture that illustrates the contact of the magnet 20*a* on the body 1 and the magnet 20 on the cover 3. By using the wings 27 and 27*a* on the outer surface of the barriers 22 and 22*a,* the magnets 20 and 20*a* can be placed on the body 1 and the cover 3. As shown in FIG. 8A, FIG. 8B and FIG. 11, the stoppers 33 are placed around the outer surface of the housing 21 and a small space 32 is placed inside the barrier 22 so that the magnet 20 can move. To prevent excessive movement of the magnet 20, a keeper layer 34 is placed on the upper ring of the barrier 22 to control the movement of the stopper 33.

An example of the stopper 33 on the outer surface of the magnet 20 is:

In order to attach one magnet 20 to the other magnet 20*a,* the former moves upwards, and the stopper 33 is placed at the inner limiting part so that the magnet 20 can move up and down. This prevents a too rigorous movement of the magnet.

Thus, the stopper 33 together with the inner keeper layer 34 prevents the magnet 20 from coming apart, and it also forms a small space 32 for the magnet 20 to move around. This allows the magnet 20 to come closer to the other magnet 20*a*.

The stopper 33 positioned at the housing 21 is placed in the space 32, and the inner keeper layer 34 put inside the barrier 22 is placed such that the stopper does not detach.

Occasionally the stopper 33 is not placed but rather the magnet 20 or the magnet housing 21 is designed similar to the external looking of the stopper 33. This allows the magnet 20 to be confined to the inner keeper layer 34. This prevents a too rigorous movement of the magnet.

In FIGS. 9A–9D, several practical usages of the invention's magnetic buttons, the wings 27 and 27*a,* button holes 26 and 26*a,* and the fixed pads 32 and 32*a* are shown.

Figure 9A:
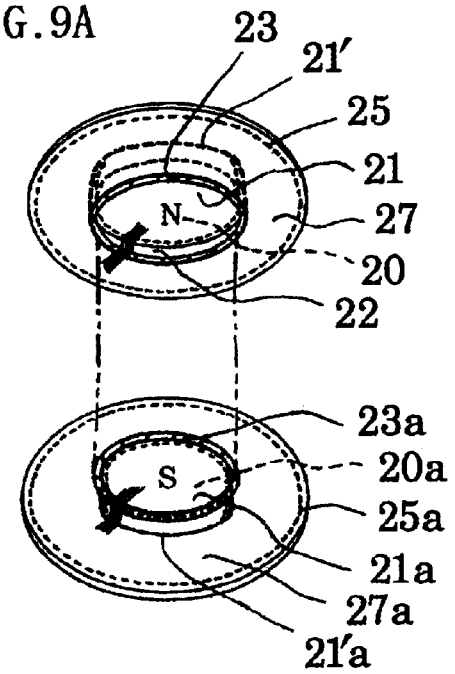
FIGS. 9A–9D show the structure of the magnet body and cover and their application.

In FIG. 9A, the magnet housing body 21, barrier 22, limiting band 23 and the wing 27 are first assembled. Then, the magnet 20 is placed inside the housing body 21 together with the housing bottom layer 21'. On the other side, the magnet housing body 21*a,* the limiting band 23*a,* and the wing 27*a* are placed inside the housing body. Then the bottom layer 21' is fixed. Along the sewing line on the wings 27 and 27*a,* final sewing is done to fix both the body 1 and cover 3.

Figure 9B:
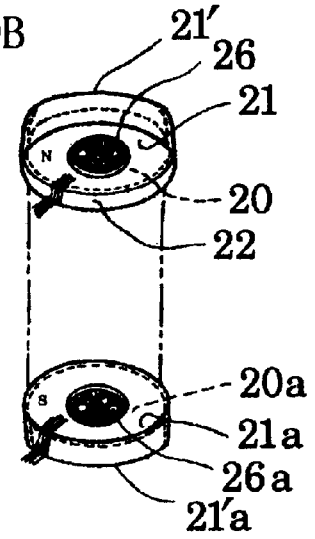

In FIG. 9B, the magnet housing body 21, the barrier 22 and the button hole 26 are first assembled. Then, the magnet 20 is placed inside the housing body 21. Furthermore, the housing bottom layer 21' is placed. On the other side, the housing body 21*a* and the button hole 26*a* are first assembled. Then the magnet 20*a* is placed inside the housing 21*a* together with the bottom layer 21'*a*. Through the button holes 26 and 26*a* in the middle of the magnet housing body 21 and 21*a,* the magnetic buttons on the body 1 and cover 3 are sewn.

Figure 9C:
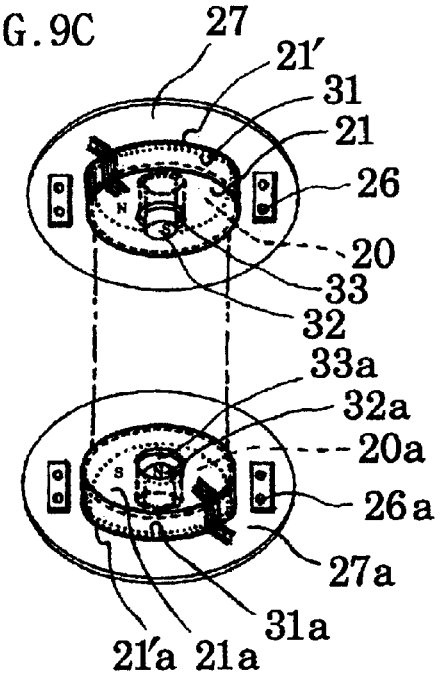

In FIG. 9C, the magnet housing body 21, wings 27, and button holes 26 are assembled. Then, the magnet 20 is put inside the housing body 21. The column base 28 with the column 29, and the bottom layer 21' are additionally put together. On the other side, the magnet housing body 21*a,* wing 27*a,* and button hole 26*a* are first assembled. Then, the magnet 20*a* is put inside the housing body 21*a,* and the column 29*a* with the column base 28*a* and the bottom layer are further put together. Though the button holes 26 and 26*a* placed at either side of the wings 27 and 27*a,* the magnetic buttons are fixed on the body 1 and cover 3 by sewing.

Figure 9D:
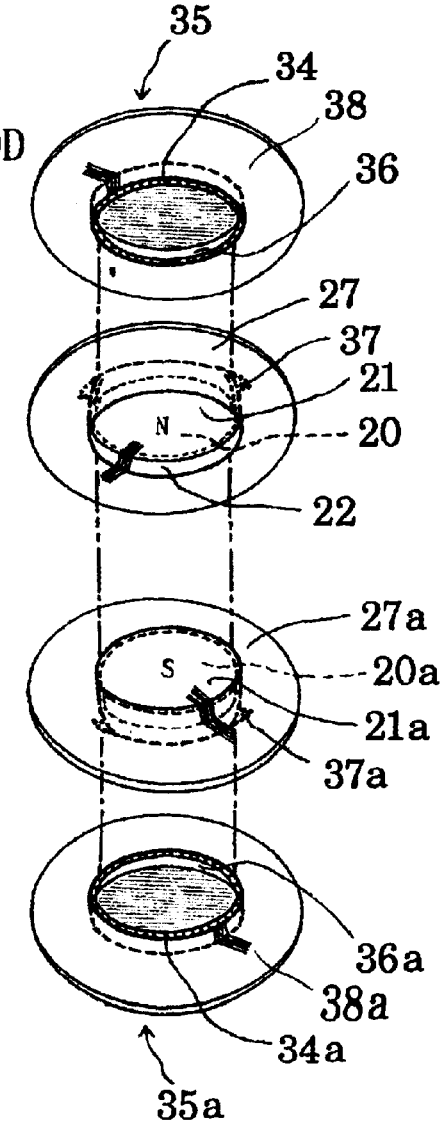

In FIG. 9D, the magnet housing body 21 and the barrier 22, and the protruded keeper layer 37 and wing 27 are assembled first. Then, the magnet 20 is placed inside the housing 21. The bottom layer 21' of the housing is then fixed. On the other side, the housing body 21*a,* protruding keeper layer 37*a,* wing 27*a* are placed first, followed by putting the magnet 20*a* inside the body 21*a*. Then, the bottom 21'*a* is put together. The fixed wings 38 and 38*a,* the fixed walls 36 and 36*a,* and the inner keeper layers 34 and 34*a* are fixed to become the fixed box 35 and 35*a*. This is put firmly inside the protruding keeper layer at the body of the housing 21 and 21*a,* so that the inner keeper layers 34 and 34*a* on the inside of the fixed box 35 and 35*a* come in contact with the protruding keeper layers 37 and 37*a*. Finally, the magnetic buttons are put on the body 1 and the cover 3.

As above, the magnetic buttons on both body 1 and flap 3 can be installed according to FIGS. 9A, 9B, 9C, and 9D, placing both magnetic buttons by the same method. Moreover, it is possible to install a magnetic button on the flap in upper 9A and another one on the body in lower 9B. Additionally, it is possible to fix the magnetic buttons both on the flap and on the body by the method of pressing or punching.

Figure 10A:
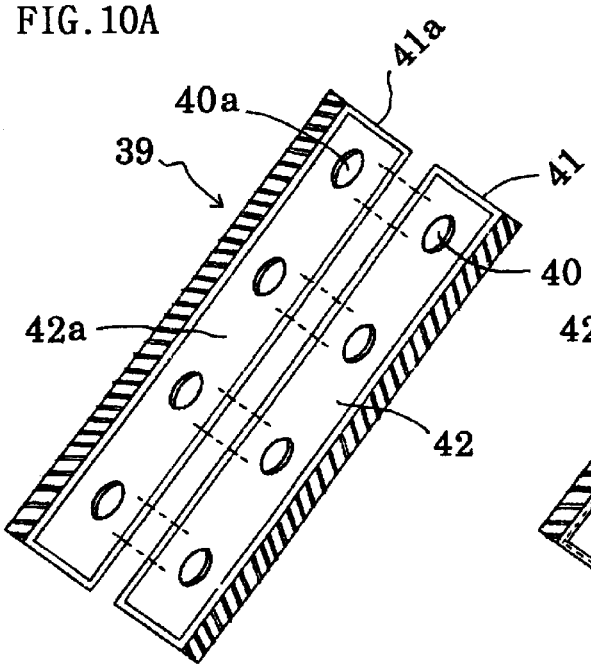
Figure 10B:
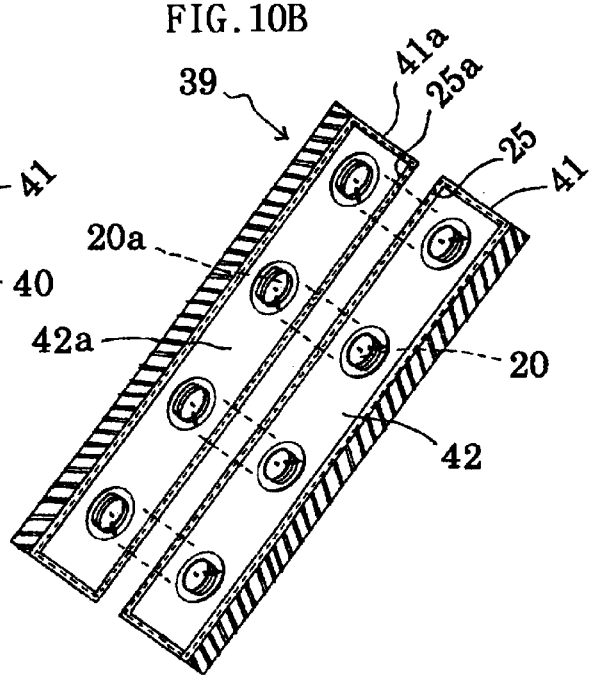

FIGS. 10A and 10B are the detailed draft for a magnetic zipper by spreading out the magnetic buttons. FIG. 10A is the detailed illustration of a zipper opening-closing layer 41 and 41*a* before installation of a magnetic button. Zipper layers 41 and 41*a* are arranged such that the body and the cover 3 face each other. Then, magnet holes 40 and 40*a* are punctured at regular intervals on the floor parts 42 and 42*a* of the magnetic zipper 41 and 41*a*. As shown in FIG. 10B, several magnetic buttons are inserted into the holes 40 and 40*a* to make the magnetic buttons installed on the zipper layer 41 of the body 1. Similarly magnetic buttons are installed on the zipper layer 41*a* of the cover 3. This makes the magnetic buttons on both the body 1 and the cover 3 face each other with opposite polarities. Many buttons are installed at once such that magnet zippers 39 can be used instead of ordinary zippers which are made by sewing partly or entirely following sewing lines 25 and 25*a*.

It is also possible to install the magnetic buttons on the floor 42 and 42*a* of the zipper layers 41 and 41*a* without making the holes 40 and 40*a* as mentioned previously.

The magnet contact between the buttons 20 and 20*a* is explained below.

As shown in FIG. 12, after two magnets are placed at regular intervals d1, two magnets 20 and 20*a* with opposite polarities, will attract each other, so that users don't have to carefully place them correctly. As shown in FIGS. 5A and 5B, if the flap 3 is closed towards the body 1, magnet 20 on flap 3 will come into contact with the magnet on the body 3. During this process, the magnet housing 21 on the flap 3 will get close to the magnet housing 21*a* on the body 1 and separated magnets 20 and 20*a* will be attached once again.

The magnets 20 and 20*a* can come into contact with each other without any mismatch due to the guidance of the magnet housing 21 and 21*a* to find their right positions.

Then the magnets 20 and 20*a* guided into the magnet housing 21 and 21*a* will not skid by the barriers 22 and 22*a* on the outside of the magnet housing, and the contact of the magnets will be enhanced as well.

When flap 3 is being closed, the contact of the two magnets with opposite polarities can be guided by the barriers 22 and 22*a* on the magnetic housings 21 and 21*a*. The barriers prevent the mismatch of the magnets and make it easy for users to operate.

The polarities and position of the magnetic buttons on the body 1 and on the flap 3 can be reversed. As shown in FIGS. 6A and 6B, they can be installed openly without having the magnet housing floor 21' and 21*a'*.

Moreover, as shown in FIG. 11, the two opposite magnets can be installed not on the upper part of the magnet housing 20 and 20*a* but on the external surface to make them contact directly.

A metal plate can be placed on the lower part of the magnets 20 and 20*a* to make the magnetic field even stronger. This provides users with more comfort. The magnet housings 21 and 21*a* and barrier 22 and 22*a* and boundary 23 and 23*a* and wing 27 and 27*a* can be the same shape as the magnets or partially changed for different shapes, if necessary.

As shown, this invention will prevent any slipping motion by the magnetic buttons and will guide the magnets to the correct position, giving more stability and making operation faster and easier. When the expendability of fashionable designs are concerned, this invention allows a wide range of application. Thus, creativity of shape and pattern is enhanced.

This invention is to increase the effectiveness of magnetic buttons used in any type of bags. It prevents the mismatch of the two buttons, increasing stability and the comfort of use. Moreover, having various shapes and patterns, the magnetic buttons can be used in many other ways.

What is claimed:

1. A magnetic button and installation structure on an item having a body and a flap comprising:

magnets having housings, said magnets placed on the body and the flap, the magnet housings placed on the outer side of two magnets, a barrier placed around the magnet housing, a magnet having a first polarity placed on the body, a magnet having a second polarity placed on the flap, the first polarity magnet of the body and the second polarity magnet of the flap respectively placed where the body and the flap correspond in order to face each other, a magnet housings having a magnet housing body and a magnet housing button layer respectively placed surrounding the first polarity magnet and the second polarity magnet, one housing able to move into the other housing upon attachment, said barrier placed around the magnet housing to prevent the slipping of the first polarity magnet and the second polarity magnet and to guide magnet into contact conjunction, wings respectively placed on the outside of the magnet housing body and said barrier, protruding keeper layers respectively placed on a lower side of the magnet housing of the body and the magnet housing of the flap, and matched with a fixed box composed of a fixed wing, fixed wall, and an inner keeper layer, protruding keeper layer on the magnet housing pressed and fixed to an inner keeper layer on the fixed box.

2. A magnetic button and its installation structure of claim 1, wherein the first polarity magnet and the second polarity magnet can be reversed and installed alternatively.

3. A magnetic button and its installation structure of claim 1, wherein the button has a magnet housing bottom layer or the upper end of the magnet housing body in opened form.

4. A magnetic button and its installation structure of claim 1, wherein stoppers are placed around the outer surface of the magnet housing and a small space is placed inside the barrier so that the magnet can move, the inner keeper layer is placed on an upper ring of the barrier to prevent excessive movement of the magnets, whereby the magnet can move within a limited range.

* * * * *